United States Patent [19]

Le Mer et al.

[11] Patent Number: 4,958,765

[45] Date of Patent: Sep. 25, 1990

[54] DEVICES FOR CONTROLLING AND REGULATING THE GAS SUPPLY TO THE BURNER OF A BOILER OR SIMILAR

[75] Inventors: Joseph Le Mer, St. Thegonnec; Bernard Martel, Chatou, both of France

[73] Assignee: Chaffoteaux Et Maury, Montrouge, France

[21] Appl. No.: 427,516

[22] Filed: Oct. 26, 1989

[30] Foreign Application Priority Data

Nov. 16, 1988 [FR] France ..... 88 14882

[51] Int. Cl.[5] ..... F23N 1/10

[52] U.S. Cl. ..... 236/20 R; 137/98; 431/90

[58] Field of Search ..... 431/90; 236/15 BD, 20 R; 137/98

[56] References Cited

U.S. PATENT DOCUMENTS

| | | | |
|---|---|---|---|
| 1,573,079 | 2/1926 | McKee | 137/98 X |
| 1,892,115 | 12/1932 | McKee | 137/98 X |
| 2,311,061 | 2/1943 | Lutherer | 431/90 X |
| 2,416,453 | 2/1947 | Mather et al. | 431/90 X |
| 3,158,320 | 11/1964 | Duncan | 431/90 X |
| 3,827,849 | 8/1974 | Nelson | 431/90 |
| 4,097,219 | 6/1978 | Prowald | 236/15 BD X |
| 4,585,021 | 4/1986 | Belknap | 431/90 X |
| 4,717,333 | 1/1988 | Carignan | 431/90 X |
| 4,793,798 | 12/1988 | Sabin | 431/90 |

*Primary Examiner*—William E. Tapolcai
*Attorney, Agent, or Firm*—Larson and Taylor

[57] ABSTRACT

A device is divulged for controlling and regulating the gas supply to the burner of a boiler or similar, which device comprises a piloted regulator (R) with a leak valve (8) for the gas flow. The burner is also fed with pressurized air and opening of the leak valve is slaved to the flow of this pressurized air so that the ratio between the two air and gas flows permanently has a value providing excellent combustion of the air-gas mixture in the burner.

8 Claims, 1 Drawing Sheet

Figure 1:
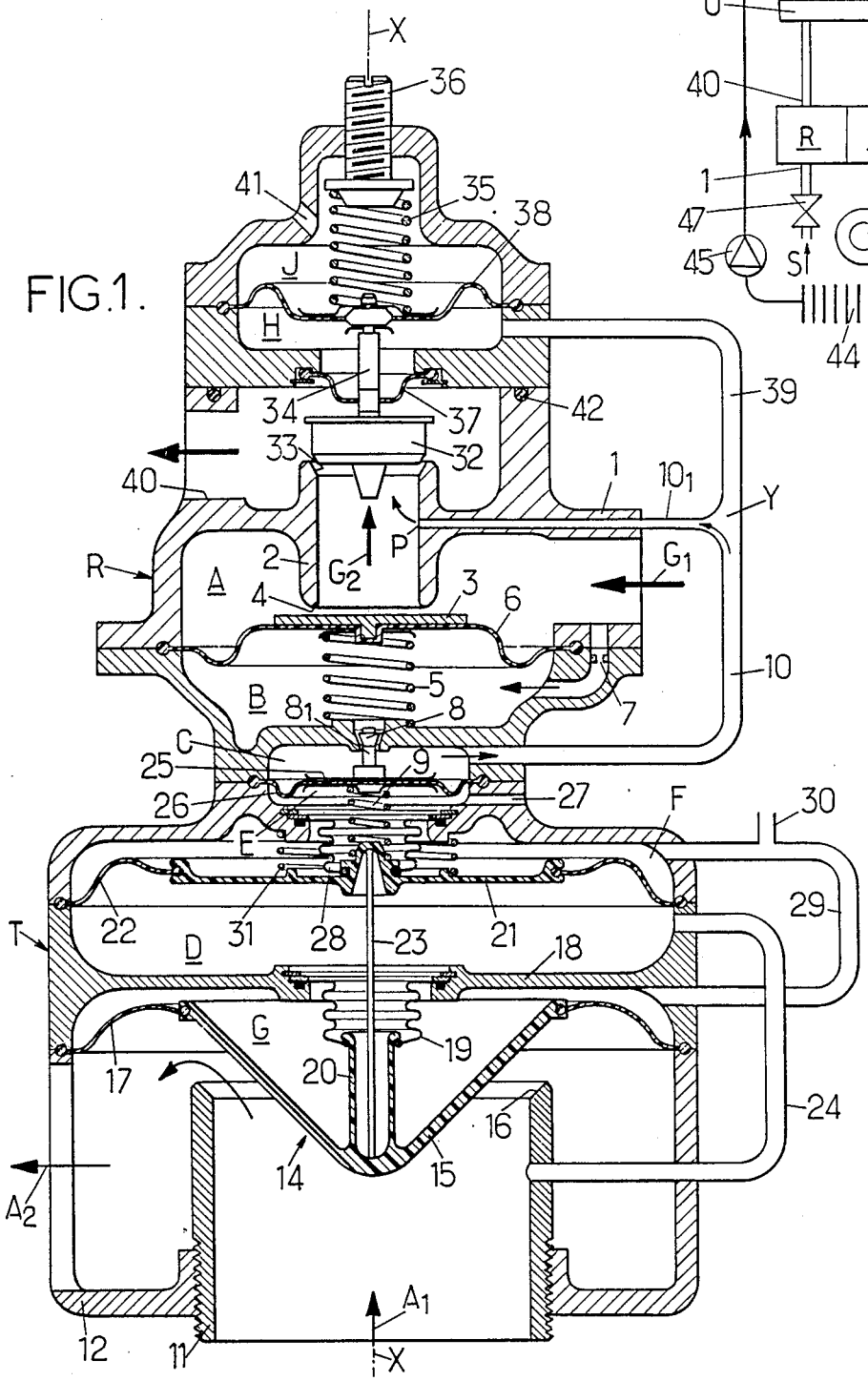

DEVICES FOR CONTROLLING AND REGULATING THE GAS SUPPLY TO THE BURNER OF A BOILER OR SIMILAR

The invention relates to devices for controlling and regulating the pressurized fuel gas supply of a gas burner for heating water flowing through a hot water central heating boiler or a similar unit such as a water heater or bath heater.

For the sake of clearness, but of course in no wise limitatively, these units will be designated hereafter by the word "boilers".

Among the control and regulation devices of the kind in question, the invention relates more particularly to those having a conduit for the pressurized gas, which conduit has an inlet, an outlet and a piloted pressure control regulator for the gas, i.e. an appliance mounted in the gas intake pipe and adapted for adjusting to a constant value the pressure of the gas coming from a source, such as the mains, which has a slightly variable pressure, which appliance comprises a gas valve urged against its seat by a spring and fast with a sealed membrane which separates a sealed chamber into two compartments, one of these compartments being connected directly to the source and comprising the seat of the valve and the other compartment being connected both to the source through a calibrated restriction and to the outlet of the appliance through a leak valve set to a certain pressure by a spring.

Known boilers equipped with such piloted pressure control regulators—called "piloted regulators" hereafter —further comprise, mounted downstream of this regulator, a control device actuated for example from the flow itself of the water to be heated.

In these boilers, the range over which it is possible to regulate the gas flows admitted to the burner is relatively narrow, this range generally extending from 1 to 3 (in that the maximum flowrate of each gas component is almost three times greater than its minimum flowrate), and exceptionally from 1 to 5 or 1 to 6.

Thus, to give an example, present day boilers may generally use air flows between 10 and 30 $m^3/h$, which corresponds to gas flows between 0.75 and 2.5 $m^3/h$ and to heating powers of the order of 7 to 20 megacalories (it will be recalled that a megacalorie is equal to 1.16 kW).

In other words, with the same known boiler of the above kind, it is difficult:

to generate a low power heating supply as is often required for central heating boilers operating under cruising conditions without requiring a succession of cycles for extinguishing and re-lighting the boiler, and to generate high heating power as is required for rapidly raising the temperature of a premises or for instantaneously heating the water intended for sanitary use such as supplying a shower or filling a bath.

The object of the invention is especially to make the control and regulation devices of the kind in question such that they make it possible to generate heating powers over much wider ranges than those known heretofore, these ranges extending over an interval from 1 to 20 with a very low minimum value, making use exclusively of fluid controls using the pressurized gas and pressurized air, i.e. in particular without requiring sophisticated accessories such as ultra sensitive sensors and electronic control circuits.

The very low "minimum value" of the above mentioned range corresponds particularly to the production of very small flames, scarcely visible to the naked eye, which of course requires the use of gas nozzles of very small flow section; such a very low minimum value may, for example, correspond to an air flow of the order of 3 $m^3/h$ only and correspondingly to a gas flow of the order of 0.25 $m^3/h$.

For this, the control and regulation devices of the kind in question in accordance with the invention still comprise a piloted regulator of the above defined kind and they are essentially characterized in that they further comprise means for supplying the burner not only with pressurized gas but also with pressurized air, the gas flow being slaved to that of the air so that the combustion of the air-gas mixture in the burner is permanently practically complete, said regulation means comprising a conduit for the pressurized air, with an inlet, and outlet and an intermediate air valve and being adapted so as to slave the opening of the leak valve of the piloted regulator to the air flow through said air conduit, which opening varies in the same direction as said air flow and means for applying to the gas stream leaving the piloted regulator a slight counter pressure as a function of the pressure prevailing downstream of the leak valve, which counter pressure varies in the opposite direction to said pressure.

In preferred embodiments, recourse is further had to one or more of the following arrangements:

the means for adjusting the degree of opening of the calibrated leak valve comprise the air valve mounted so as to be urged open by the air stream itself and means for applying the movements of the air valve to the calibration spring of the leak valve, the air valve is fast with a sealed membrane itself connected sealingly to the air outlet, and a sealed chamber whose inner volume communicates with the air inlet is interposed between this valve and the calibration spring, said chamber being defined partly by a rigid ring forming part of the casing of the device, partly by a sealed bellows connecting the inner edge of the ring to the central zone of the air valve and partly by a rigid plate sealingly connected by a flexible membrane to the outer edge of the ring, said plate being applied on the one hand, in the direction corresponding to opening of the valve, against the calibration spring and, on the other hand, in the opposite direction to the preceding one, against the air valve through a thrust rod passing freely through the chamber and in particular its bellows;

in a regulation device according to the preceding paragraph, a second sealed chamber is formed outside the bellows with the air valve, its membrane and the rigid portions of the casing to which they are connected, a second sealed bellows connects the centre of the plate to an annular rigid bearing surface of the casing surrounding the calibration spring, a third sealed chamber is formed outside the second bellows with the plate and its membrane and the second sealed chamber is placed in communication with the third one so as to be able to be placed in communication simultaneously with an appropriate zone of the boiler, such as the inside of its heating body, in a device according to the preceding paragraph, a second spring disposed inside the third chamber is interposed between the plate and an annular bearing surface forming part of the casing, this spring being a helical compression spring which successively surrounds the second bellows and the calibration spring, a sealed chamber which may be vented and which comprises the volume inside the second bellows, is formed by this bellows, by a sealed membrane fast with the leak valve and by portions of the casing to which the bellows and its membrane are connected, the means for applying a counter pressure to the outgoing gas stream comprise a second gas valve urged upstream by a calibrated spring in the direction of a seat in the gas conduit downstream of the first gas valve of the piloted regulator and this second gas valve is fast with a rod itself carried by two sealed membranes which are connected to the casing and which define a sealed chamber about this rod, which chamber is placed in communication with the chamber which is disposed just downstream of the leak valve so that the pressure prevailing in this latter chamber opposes that of the calibrated spring, the circuit in which the water flows which is heated by the burner fed by means of a regulation device of the above kind is equipped with a pump causing this water to flow permanently and the inlet of the air conduit of the regulation device is connected to the output of a fan whose rotational speed is slaved to the temperature of said water at a given point of said circuit.

Apart from these main arrangements, the invention comprises certain other arrangements which are preferably used at the same time and which will be more explicitly discussed hereafter.

In what follows, a preferred embodiment of the invention will be described with reference to the accompanying drawings in a way which is of course in no wise limitative.

Figure 2:
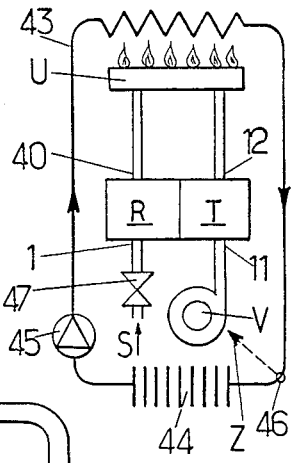

FIG. 1 of these drawings shows in axial section a device constructed in accordance with the invention for regulating the flow of the pressurized fuel gas which feeds the burner of a boiler as a function of the flow of pressurized air feeding this same burner;

FIG. 2 shows very schematically a central heating installation equipped with such a device.

In a way known per se, the devioe considered comprises a piloted regulator R whose inlet 1 is fed with fuel gas G at a slightly variable pressure from a source S such as a town mains, this regulator being intended to deliver at its outlet 2 a gas flow $G_2$ at constant pressure.

This regulator comprises a gas valve 3 which is urged against its seat 4 by a spring 5 and is fast with a sealed membrane 6 which separates a sealed chamber into two compartments A and B, one of these compartments A being connected directly to the inlet 1 and comprising seat 4 and the other compartment B being connected both to the inlet 1 through a calibrated restriction 7 and to the outlet 2 successively through a leak valve 8 calibrated by a spring 9, a chamber C through which the rod $8_1$ of this leak valve passes and a duct 10.

In piloted regulators known up to present—which regulators are intended solely for eliminating the small pressure variations of the gas supply—spring 9 is calibrated once and for all by means of an adjustment screw and the control and regulation of the gas flow feeding the burner are provided by complementary means which are in particular slaved to the flow of water to be heated.

In the present case, to spring 9 is applied a force which varies in the same direction as a flow of pressurized air feeding burner U.

In other words, the control and regulation of the gas supply to burner U are here slaved directly to the flow of the pressurized air feeding this same burner.

The regulation in question is determined automatically so that the ratio between the two air and gas flows has permanently the value corresponding to the stoichiometric composition of the mixture, with a slight excess of air, so that combustion is as complete as possible.

It is then sufficient, to control and regulate the double supply of the burner both with air and gas, to adjust the air flow alone, particularly by modifying the blowing power of a fan V forming the pressurized air source.

For this, to the above described piloted regulator R is added a complementary casing T through which passes a conduit for the pressurized air feeding the burner, which conduit extends from an inlet 11 to an outlet 12.

This conduit is equipped with an "air valve" 14 capable:

on the one hand of adapting itself automatically to the flowrate and to the pressure of the air applied to inlet 11, and on the other hand to act on the leak valve 8, or more exactly on its spring 9, i the above indicated direction.

The construction of the air valve 14 must be such that it is extremely sensitive to the variations of the pressure of the air applied to inlet 11.

For this, recourse is had to the two following arrangements:

said valve is formed by a floating assembly supported solely by flexible annular membranes, which makes it possible to completely do away with sliding seals and mechanical guides likely to develop hysteresis for the reversals of movement, said valve is arranged as a force multiplying mechanism in which the upstream pressure of the air is applied not only to the valve properly speaking, but also to another bearing surface associated with said valve.

The air valve illustrated uses these two arrangements.

For this it comprises a valve properly speaking 15 formed by a rigid cone converging upstream and adapted for cooperating with an annular seat 16 forming part of the inlet section 11 and having as axis the general axis of revolution X of the device: this axis is assumed vertical in the drawings, inlet 11 then being disposed at the base of the device.

Valve 15 is supported by a sealed annular membrane 17 which is itself connected sealingly to the outlet 12, or more exactly to an appropriate portion, of casing T, adjacent this outlet 12 which is here materialized by a lateral aperture formed in a cylindrical wall.

Furthermore, a sealed deformable chamber D is formed inside casing T between valve 15 and spring 9.

This chamber D is defined:

by a rigid ring 18 forming part of casing T, by a sealed and flexible bellows 19 connecting the inner edge of ring 18 sealingly to the centre of the conical valve 15 through a well 20, by a rigid plate 21 whose transverse area is greater than that of the central orifice of ring 18, and by a flexible annular and sealed membrane 22 connecting the edge of plate 21 to the periphery of the rigid ring 18.

Plate 21 is itself applied:

on the one hand in the downstream direction of the air stream admitted into inlet 11, i.e. towards the top of the drawing, against spring 9, and on the other hand in the opposite direction, i.e. upstream of the air stream or downwards, against valve 15 itself through a thrust rod 23 passing through chamber D and in particular bellows 19 and well 20, this rod 23 being simply interposed between plate 21 and valve 15 without being rigidly assembled with these parts.

The inside of chamber D is placed in communication with the inside of the inlet section 11 by a conduit 24.

The upstream pressure of the air entering the device is thus applied in chamber D and since the transverse area of the mobile assembly formed by plate 21 and membrane 22 is greater than the transverse area of well 20, the result is an upward thrust on plate 21 which is exerted in the same direction as the thrust exerted on valve 15.

Spring 9 is not disposed inside the above chamber C, but in a chamber E outside this chamber C.

Said chamber C is defined on the spring 9 side by a small plate 25 fast with rod $8_1$ of the leak valve, which plate is itself connected by a sealed annular membrane 26 to casing T.

Chamber E may be vented by a passage 27 formed in the wall of casing T.

This chamber E could be juxtaposed to chamber D over the whole extent of wall 21 and membrane 22, but it is preferable to partially define, by these latter two elements, another chamber F which is separated from chamber E by a sealed bellows 28 connecting the centre of plate 21, on its face opposite chamber D, with an annular bearing surface of casing T.

Furthermore, the assembly of dividing walls formed by valve 15, its peripheral membrane 17, the rigid ring 18 and bellows 19 defines another sealed chamber G and this other chamber G is placed in communication with chamber F by a conduit 29, so that the two chambers F and G are subjected to the same pressure.

In advantageous embodiments, this pressure is made equal to that which prevails in the boiler furnace by causing its inner volume to communicate with conduit 29 through another connecting conduit 30.

There is further shown in the FIG. 1 a helical compression spring 31 disposed about bellows 28 inside chamber F, which spring is interposed axially between plate 21 and a rigid annular bearing surface of casing T.

This spring 31 reinforces the force of spring 9 tending to apply plate 21 against the thrust rod 23, which slightly compensates for the force multiplying effect exerted in the opposite direction by the very existence of chamber D.

In a variant, spring 31 could be omitted since it is not indispensable for the general operation of the assembly; nevertheless, it improves the accuracy and simplifies the optimization of the membrane diameters.

The operation of the above described device is the following.

When no air pressure is applied to inlet 11, valve 15 is applied against its seat 16 by the expansion of springs 9 and 31.

Spring 9 is then in its maximum extended position corresponding to closure of the leak valve 8.

The gas pressures which prevail respectively in the two compartments A and B are then identical and the expansion of spring 5 applies the gas valve 3 against its seat 4: no gas flow is then delivered through outlet 2 to burner U.

When an air flow $A_1$ is applied to inlet 11, valve 15 is moved away from its seat 16, which leads to the following consequences:

an air flow $A_2$ is delivered through outlet 12, the spring 9 of leak valve 8 is compressed, which opens this valve, a small gas flow is discharged through the opening of this valve outside compartment B, which reduces the pressure of the gas in this compartment, this pressure reduction results in the opening of gas valve 3 and so in the delivery of a gas flow $G_2$ at outlet 2.

This gas flow $G_2$ is all the higher the higher the air flow $A_2$ which gives rise thereto.

The sizes and other characteristics of the device are chosen so that the ratio between these two flows $A_2$ and $G_2$ corresponds permanently to complete combustion of their mutual mixture at the level of the burner of the boiler.

It is then sufficient, to control and regulate the air and gas flows feeding the burner U of the boiler, to adjust fan V which generates the air flow intended for this supply; it is in particular pointless using sophisticated electronic slaving or detection systems.

So that the device may operate even with very small gas flows, recourse is further had to the following arrangement.

To the stream $G_2$ of this gas is applied a counter-pressure which is regulated by a second gas valve 32 urged countercurrent wise, namely towards an annular seat 33 forming part of the outlet 2 in the direction opposite that of the gas stream flow.

The pressure exerted on this second gas valve 32 is itself adjusted as a function of the gas leak passing through valve 8 in the following way.

Valve 32 is extended downstream, i.e. towards the top of the drawing, by a rod 34.

The pressure of a spring 35, adjustable by a calibration screw 36 screwed into casing T, is applied axially against the upper end of rod 34.

In addition, this rod 34 passes through a sealed chamber H defined by two sealed annular membranes 37 and 38 supporting the rod and connecting it with the casing, said chamber H being placed in communication with chamber C by a conduit 39.

As can be seen in the drawings, this conduit 39 is connected at Y to the above conduit 10 and the downstream section of this latter conduit, designated by reference $10_1$, emerges into outlet 2 at a point P situated between the two seats 4 and 33.

The gas outlet of the device, disposed downstream of valve 32, is designated by the reference 40.

With such a construction, the pressure which reigns in chamber H and which opposes the force of spring 35 is all the smaller—and so the pressure exerted on the second gas valve 32 in the direction of closure is all the higher —the smaller the leak through valve 8.

Consequently, for very small gas flows, the flow section between the second gas valve 32 and its seat 33 is very small and conversely.

Chamber J which is formed about spring 35 is here vented by a passage 41 formed in the wall of casing T.

This chamber J, like the above chamber E, could be used for providing for the device a control or corrective means other than those explained above.

The whole of the rigid casing of the device may be formed, as shown in the drawings, by a stack of a number of cups of revolution about axis X applied axially against each other with crushing of peripheral rims of membranes (17, 22, 26, 6, 37, 38) or an O seal (42).

FIG. 2 relates to a preferred embodiment of a hot water central heating installation equipped with a regulation device of the above described kind.

This FIG. 2 shows a certain number of elements already described above, which have been given the same references as before.

Moreover, the circuit in which the water heated by burner U flows is a continuous circuit designated by reference 43 which passes through heating radiators 44 and is equipped with a circulating pump 45 permanently rotating and an aquastat 46 adapted for permanently taking the temperature of the water at a given point.

Arrow Z symbolizes the slaving of the control of fan V to the temperature detected by the aquastat 46, or more precisely to the difference between a predetermined reference temperature, generally adjustable at will and said detected temperature.

Such slaving may lead to a succession of cycles each comprising the temporary complete extinction of the burner and automatic re-lighting thereof by means of an igniter, not shown.

Reference 47 designates a safety cock mounted on the gas intake.

Following which and whatever the embodiment adopted, a device is finally obtained for controlling and regulating gas flows supplying the burner of a boiler whose construction and operation follow from the foregoing.

This device has numerous advantages with respect to those known heretofore and in particular the following:

it makes possible extremely sensitive and faithful slaving of the gas flow to that of the air flow, over a very extensive range, for example from 0.25 to 3.75 $m^3/h$ for the gas and 3 to 45 $m^3/h$ for the air, the corresponding pressures going from 10 to 50 millibars for the gas and 0.2 to 7 millibars for the air, the operation is particularly interesting since it uses exclusively the energies of the two fluids (air and gas) whose flow rates it is desired to control mutually, the cost price is itself moderate because no sophisticated electronic slaving or detection system is used, the safety in operation of the device is very high: thus, although it is permanently fed from the town gas mains, it remains totally closed with respect to this gas as far as no air flow is applied thereto, in the preferred embodiment in which two chambers F and G are provided placed in communication with the inner volume of the heating body of the boiler, additional safety is automatically obtained should certain malfunctions occur, such as partial obstruction of the fume discharge duct or of the exchanger: in fact, in such a case, the pressure prevailing in said volume increases, which tends to automatically close the air valve while reducing both the air and gas flows.

As is evident, and as it follows moreover already from what has gone before, the invention is in no wise limited to those of its embodiments and modes of application which have been more especially considered; it embraces, on the contrary, all variants thereof.

What is claimed is:

1. Device for controlling and regulating a pressurized fuel gas supplied to a gas burner for heating water flowing through a boiler or similar, comprising a conduit for the pressurized gas, which conduit has an inlet (1), an outlet (2) and a piloted regulator (R) comprising a gas valve (3) urged against a seat (4) by a spring (5) and fast with a sealed membrane (6) which separates a sealed chamber into two compartments, one of these compartments (A) being connected directly to the inlet and comprising the seat of the valve and the other compartment (B) being connected both to the inlet through a calibrated restriction (7) and to the outlet through a leak valve (8) set to a certain pressure by a calibration spring (9), characterized in that said device further comprises means for supplying the burner (U) not only with a flow of pressurized gas but also with a flow of pressurized air, the gas flow being slaved to that of the air so that a combustion of the air-gas mixture in the burner is permanently practically complete, said supplying means comprising an air conduit for the pressurized air, with an inlet (11), an outlet (12) and an intermediate air valve (14) and being adapted so as to slave an opening of the leak valve (8) of the piloted regulator (R) to the air flow through said air conduit, which opening varies in the same direction as said air flow and means for applying to the fuel gas stream leaving the piloted regulator a slight counter pressure as a function of a pressure prevailing downstream of the leak valve (8), which counter pressure varies in an opposite direction to said pressure.

2. Device according to claim 1, characterized in that the means for supplying adjusts a degree of opening of the leak valve (8) and comprises the air valve (14) mounted so as to be urged open by the air stream itself and means for applying movements of the air valve to the calibration spring (9) of the leak valve (8).

3. Device according to claim 1, characterized in that the air valve (14) is fast with a sealed membrane (17) itself connected sealingly to the air outlet (12), and in that a sealed chamber (D) whose inner volume communicates with the air inlet (11) is interposed between this valve and the calibration spring (9), said chamber (D) being defined partly by a rigid ring (18) forming part of a casing (T) of the device, partly by a sealed bellows (19) connecting an inner edge of the ring to a central zone of the air valve and partly by a rigid plate (21) sealingly connected by a flexible membrane (22) to an outer edge of the ring, said plate being applied on the one hand, in the direction corresponding to opening of the air valve, against the calibration spring (9) and, on the other hand, in the opposite direction to the preceding one, against the air valve through a thrust rod (23) passing freely through the chamber (D) and in particular its bellows.

4. Device according to claim 3, characterized in that a second sealed chamber (G) is formed outside the bellows (19) with the air valve (14), its membrane (17) and the rigid portions of the casing (T) to which they are connected, in that a second sealed bellows (28) connects a centre of the plate (21) to an annular rigid bearing surface of the casing surrounding the calibration spring (9), in that a third sealed chamber (F) is formed outside the second bellows with the plate and its membrane and in that the second sealed chamber (G) is placed in communication with a third chamber (F) so as to be able to be placed in communication simultaneously with an appropriate zone of the boiler.

5. Device according to claim 4, characterized in that a second spring (31) disposed inside the third chamber (F) is interposed between the plate (21) and an annular bearing surface forming part of the casing (T), this spring (31) being a helical compression spring which successively surrounds the second bellows (28) and the calibration spring (9).

6. Device according to claim 4, characterized in that a sealed chamber (E) which comprises the volume inside the second bellows (28), is formed by this bellows, by a sealed membrane (26) fast with the leak valve (8) and by portions of the casing (T) to which this bellows and this membrane are connected.

7. Device according to claim 1, characterized in that the means for applying a counter pressure to the outgoing gas stream comprises a second gas valve (32) urged upstream by a calibrated spring (35) in a direction of a seat (33) forming part of the gas conduit downstream of the first-mentioned gas valve (3) of the piloted regulator and in that this second gas valve is fast with a rod (34) itself carried by two sealed membranes (37, 38) which are connected to the casing (T) and which define a sealed chamber (H) about this rod, which chamber (H) is placed in communication with the chamber (C) which is disposed just downstream of the leak valve (8) so that a pressure prevailing in this latter chamber (C) opposes that of the calibrated spring (35).

8. Installation equipped with a regulation device according to claim 1, characterized in that a circuit (43) in which the water flows which is heated by the burner (U) fed by means of said regulation device is equipped with a pump (45) causing this water to flow permanently and in that the inlet (11) of the air conduit of this regulation device is connected to an output of a fan (V) whose rotational speed is slaved to a temperature of said water at a given point (46) of said circuit.

* * * * *